US005743197A

United States Patent [19]

Kinni et al.

[11] Patent Number: 5,743,197

[45] Date of Patent: Apr. 28, 1998

[54] GRATE ASSEMBLY FOR A FLUIDIZED BED BOILER

[75] Inventors: Jouni Kinni, Tampere; Jukka Louhimo, Siivikkala; Pentti Janka, Tampere; Kari Haverinen, Sääksjärvi, all of Finland

[73] Assignee: Tampella Power Oy, Tampere, Finland

[21] Appl. No.: 762,156

[22] Filed: Dec. 9, 1996

Related U.S. Application Data

[63] Continuation of Ser. No. 354,038, Dec. 6, 1994, abandoned.

[30] Foreign Application Priority Data

Dec. 7, 1993 [FI] Finland ..... 935455

[51] Int. Cl.[6] ..... F23G 5/00

[52] U.S. Cl. ..... 110/245; 122/4 D; 423/58

[58] Field of Search ..... 110/245; 432/58; 122/4 D; 165/104.16

[56] References Cited

U.S. PATENT DOCUMENTS

| | | | |
|---|---|---|---|
| 2,500,323 | 3/1950 | Puckett . | |
| 2,608,958 | 9/1952 | Hazelton . | |
| 3,665,894 | 5/1972 | Jones . | |
| 4,312,302 | 1/1982 | Kollerup | 122/4 |
| 4,357,883 | 11/1982 | Comparato et al. | 122/4 D |
| 4,429,644 | 2/1984 | Thomas | 110/245 |
| 4,753,180 | 6/1988 | Narisoko et al. . | |
| 5,203,284 | 4/1993 | Dietz | 110/245 |
| 5,425,331 | 6/1995 | Abdulally | 165/104.16 |

FOREIGN PATENT DOCUMENTS

| | | |
|---|---|---|
| 913784 | 9/1991 | Finland . |
| 118918 | 6/1900 | Germany . |
| 29 52 091 | 11/1987 | Germany . |
| 1177596 | 5/1984 | U.S.S.R. . |
| 1359619 | 7/1986 | U.S.S.R. . |
| WO 90/09550 | 2/1998 | WIPO . |

*Primary Examiner*—Thomas E. Denion
*Attorney, Agent, or Firm*—Law Offices Pollock, Vande Sande & Priddy

[57] ABSTRACT

A grate assembly for a fluidized bed boiler comprises a number of parallel sparge pipes or the like extending side-by-side in a substantially horizontal plane and provided with elements for supplying fluidizing air from within the sparge pipes or the like into a combustion chamber located above the grate assembly. The discharge of some of the fluidized bed materials is effected through an aperture system formed between the adjacent sparge pipes into a receiver unit fitted below the grate assembly. The sparge pipes are provided with a cooling medium circulation by means of a duct assembly.

12 Claims, 3 Drawing Sheets

Fig. 3
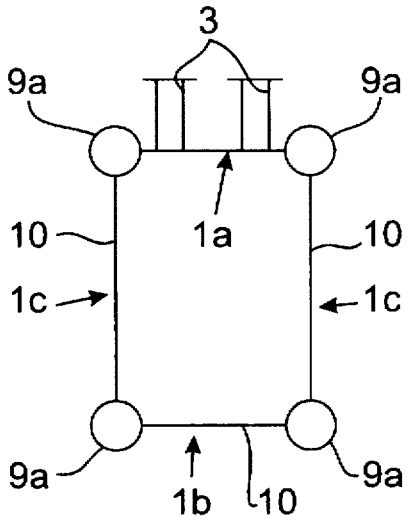
Fig. 4
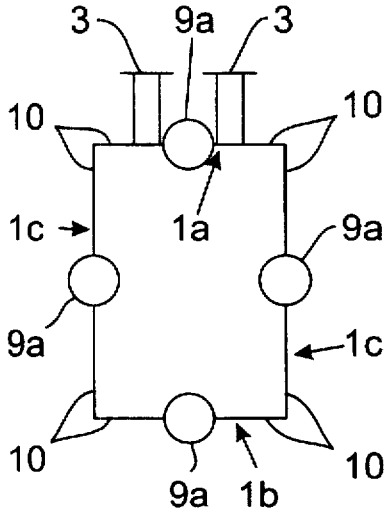
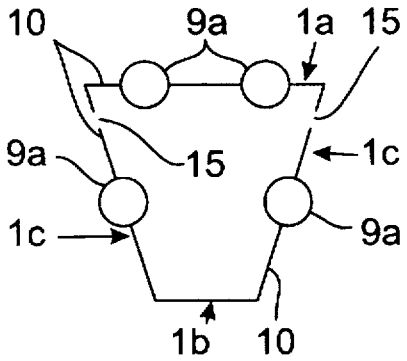
Fig. 5
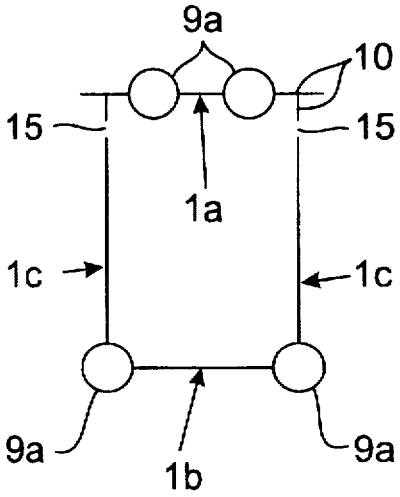
Fig. 6

GRATE ASSEMBLY FOR A FLUIDIZED BED BOILER

This application is a Continuation of U.S. patent application Ser. No. 08/354,038, filed Dec. 6, 1994 now abandoned.

FIELD OF THE INVENTION

The present invention relates to a grate assembly for a fluidized bed boiler, including at least partially a number of parallel sparge pipes or the like extending side-by-side in a substantially horizontal plane and provided with elements for supplying fluidizing air from within the sparge pipes or the like into a combustion chamber located above the grate assembly. The discharge of some of the fluidized bed materials is effected through an aperture system between the sparge pipes into a receiver unit fitted below the grate assembly.

BACKGROUND OF THE INVENTION

It is known to provide fluidized bed boilers or furnaces with a so-called sparge pipe grate assembly Regarding the prior art, reference is made to publications U.S. Pat. No. 4,753,180 and FI-913784. The sparge pipe grate assembly is preferred especially in the prevention of so-called coarsening. In a fluidized bed boiler, the fluidized bed normally comprises a sand layer which is located above the grate asssembly and fluidized by means of fluidizing air blown through the grate assembly. However, the fluidization carried out in a fluidized bed boiler and, thus, the successful combustion process in a continuous action requires a sand with a uniform particle size. During the combustion process it is necessary to remove from the fluidized bed a so-called coarser material, i.e. particularly coarser-grade sand fraction, rocks and agglomerated particles existing within the sand and produced therein in the combustion process. The continuous action of a combustion process with a high efficiency is secured by removing sand regularly from the fluidized bed over short cycles. In current technology, the coarsening of the sand in a fluidized bed can be avoided by effecting, in a continuous-action combustion process, a discharge cycle of a few minutes a few times a day. Since the sparge pipe grate assembly includes an aperture system covering essentially the entire grate assembly, the discharge cycle intended for preventing the coarsening of the sand in a fluidized bed can be carried out effectively across the entire grate assembly. By applying the sparge pipe grate assembly it is possible to make a construction, wherein the aperture system has a surface area which is approximately half of the total surface area of a sparge pipe grate assembly. Below the sparge pipe grate assembly is fitted a receiver unit for the sand removed from the fluidized bed, whereby the sand is advanced to the subsequent operation in a sand treating process. The sparge pipe grate assemblies designed according to the prior art are only cooled with the fluidizing air blown through the sparge pipes into the fluidized bed. A drawback in such a solution is the deflection or distortion of sparge pipes as a result of possible, primarily local overheating and, thus, the damaging and short service life of a grate assembly. It is obvious that the supply of fluidizing air and the discharge of sand may also be disturbed as a result of the deformations of sparge pipes. Thus, the prior art sparge pipe grate assemblies do not fulfill either the functional or constructive requirements in the demanding conditions existing in a fluidized bed boiler.

SUMMARY OF THE INVENTION

An object of this invention is to introduce a grate assembly for a fluidized bed boiler, wherein the drawbacks of assemblies constructed on a so-called sparge pipe grate principle have been successfully eliminated in a most extensive degree so as to provide a grate assembly which is durable and reliable in the demanding conditions of a fluidized bed boiler. In order to achieve this object, a grate assembly of the invention is principally characterized in that at least some of the sparge pipes or the like are provided with a cooling medium circulation. This cooling medium circulation is designed separately from a fluidizing air stream to be supplied through the sparge pipes or the like. The cooling medium comprises water, steam and/or air. In a particularly preferred embodiment, the cooling medium comprises water circulating in the water circulation and steam generation system of a fluidized bed boiler. Thus, the cooling of sparge pipes or the like included in a grate assembly can be effected as part of the steam generation process of a fluidized bed boiler.

It is preferred that the cooling medium circulation be included in the wall structure of sparge pipes or the like, preferably as a part of the wall structure. This solution is capable of providing a sparge pipe assembly functioning effectively both in constructive sense and in terms of heat transfer and having a cross-sectional area that can be divided and designed in such a manner that the resistances of flow for both the cooling medium circulation and the fluidizing air blow become reasonable.

The fluidized bed boiler refers in this context to both a circulating fluidized circulation bed boiler and a bubbling fluidized bed boiler. The invention relates also to the use of a grate assembly in the above applications.

BRIEF DESCRIPTION OF THE DRAWINGS

In the following specification, a grate assembly of the invention for a fluidized bed boiler will be described in more detail with reference made to the accompanying drawings. In the drawings FIG. 1 shows the bottom section of a fluidized bed boiler provided with one embodiment of a grate assembly of the present invention, as seen in the direction perpendicular to the longitudinal direction of sparge pipes or the like, FIG. 2 shows the assembly of FIG. 1, as seen in the longitudinal direction of sparge pipes or the like, and FIGS. 3–6 illustrate alternative embodiments for sparge pipes or the like.

DESCRIPTION OF THE PREFERRED EMBODIMENTS

Figure 1:
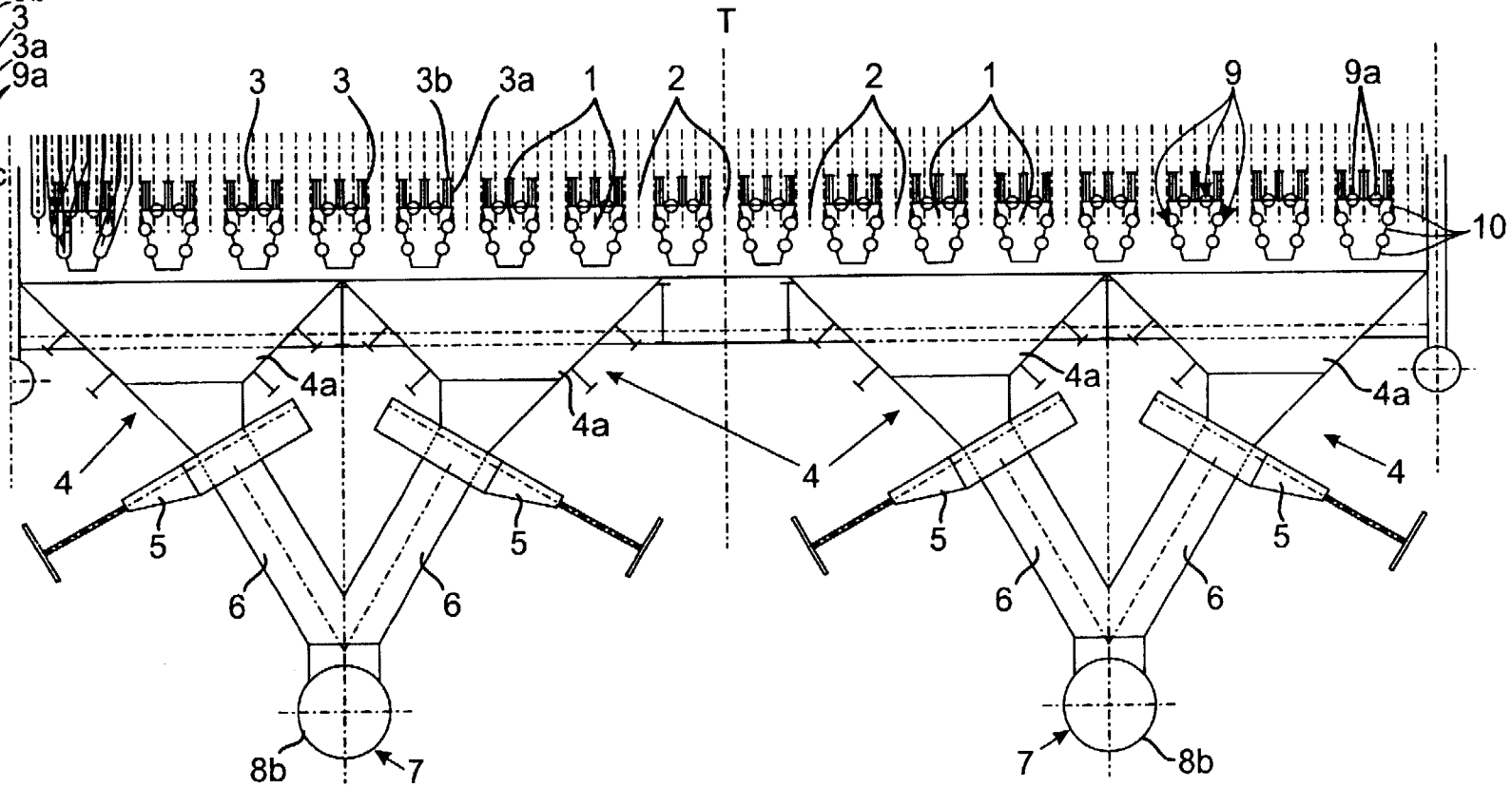
Figure 1A:
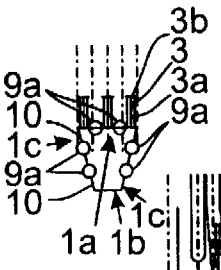
Figure 2:
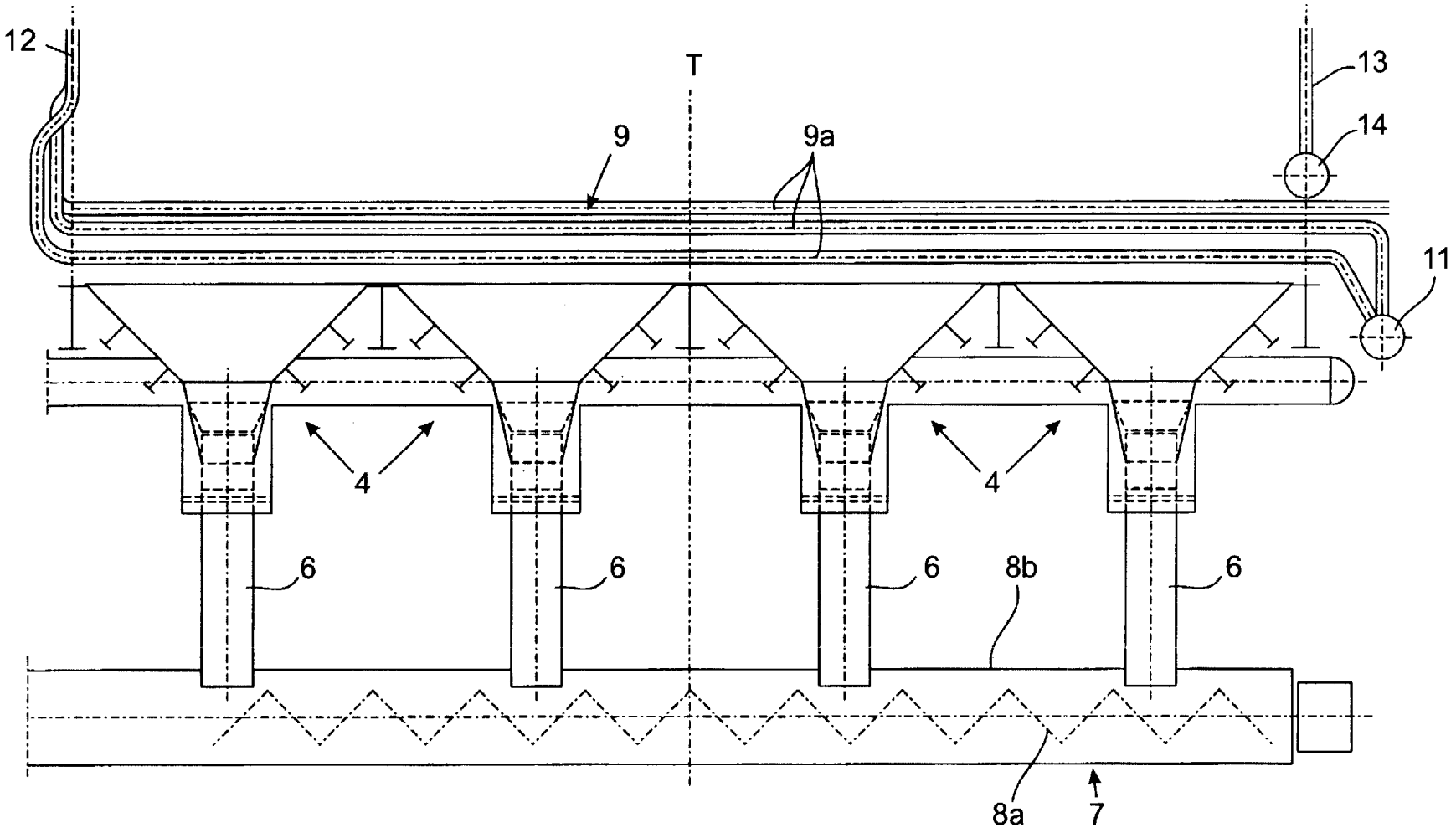

Particularly in reference to FIGS. 1 and 2, a grate assembly of the invention is included in the bottom section of the combustion chamber of a fluidized bed boiler. The overall design of a fluidized bed boiler or various aspects of a combustion process are not further specified in this context, as those are well known from the general technology in this field, e.g. from patent literature. The part of a fluidized bed boiler process, which is not actually related to the object of the invention, can be carried out in a plurality of various manners since a grate assembly of the invention enables the unlimited use of several types of alternative constructions as well as processes.

The grate assembly shown in FIGS. 1 and 2 comprises a number of parallel sparge pipes 1 extending side by side in a substantially horizontal plane. The sparge pipes 1 are mounted side by side in such a manner that between the adjacent sparge pipes remains a likewise horizontal aperture extending in the longitudinal direction of the sparge pipes, thereby providing an aperture system 2 for the grate assembly. Each sparge pipe is further provided with a number of elements for supplying fluidizing air from within the sparge pipes 1 into a combustion chamber T located above the grate assembly. It can be seen especially from FIG. 1 that the elements include fluidizing nozzles 3 extending towards the combustion chamber from a top surface 1*a* (the upper horizontal wall) included in the sparge pipes. The fluidizing nozzles comprise a vertical pipe 3*a*, mounted on the top surface of sparge pipes 1 and having its top portion fitted with a protective cap or a like 3*b*, the fluidizing air being blown from therebelow in a substantially radial direction over the entire periphery of pipe 3*a* into the combustion chamber T. The grate assembly is supported by means of a lower beam assembly (not shown).

Below the grate assembly is fitted a receiver unit 4, covering the surface area of the grate assembly and comprising a plurality of receiver funnels 4*a* which together cover the floor of the grate assembly. Below the receiver funnels 4*a* are shut-off mechanisms 5 establishing a communication along substantially vertical ducts 6 to sand discharge units 7. In the illustrated embodiment, the sand discharge unit 7 comprises a screw conveyor, including an conveying screw 8*a* (FIG. 2) to which the bottom portions of ducts 6 are in communication through a protective casing 8*b* covering the conveying screw 8*a*. A necessary number of discharge units 7 are fitted in connection with the receiver unit 4 in such a fashion that each discharge unit 7 is arranged in connection with two or more receiver funnels 4*a*. The receiver unit 4, as described above, is known in the art and it can be noted that constructively the receiver unit 4 can be designed in a variety of ways within the basic concept of the invention.

According to the invention, at least some, preferably all of the sparge pipes 1 or the like are provided with a cooling medium circulation. As shown especially in FIG. 1, the cooling medium circulation is included in the wall structure of sparge pipes 1 or the like as a part of the wall structure. The cooling medium circulation is effected by means of a duct assembly extending in the longitudinal direction of sparge pipes 1 or the like. The duct assembly 9 is preferably included centrally in the sparge pipe wall structure in a manner that a part of each duct 9*a* included in the duct assembly extends outwards from the surface of the sparge pipe and, on the other hand, a part of the cross-section extends towards the interior of the sparge pipe. Especially in the embodiment shown in FIG. 1, the duct assembly comprises six ducts, two of the ducts being included in the top surface 1*a* of a sparge pipe and two of the ducts in each side wall 1*c* of a sparge pipe, respectively. As can be noted especially from FIG. 1, the sparge pipe can have a regular cross-sectional shape, the shape of a downward narrowing trapezium, whereby the sparge pipe has a bottom surface 1*b* which is substantially parallel to the top surface. This solution serves to facilitate the transfer of sand from the combustion chamber into the receiver unit. The sparge pipes 1 are preferably welded structures, wherein the ducts 9*a* are spaced from each other in the peripheral direction of the cross-section of a sparge pipe or the like, the spacer block fitted between adjacent ducts comprising a plate-like (either a flat or angular piece) sheet element 10, which is welded to the outer surface of the duct along both longitudinal edges thereof. As shown especially in FIG. 1, the elements 3 or fluidizing nozzles for supplying fluidizing air are arranged in three rows in the longitudinal direction of sparge pipe 1, whereby the ducts 9*a* of the duct assembly 9 associated with the sparge pipe top surface are fitted between the rows. The above-described arrangement enables the provision of a symmetrical sparge pipe assembly, wherein the middle row of fluidizing nozzles extends along the vertical axis of symmetry of the cross-section of a sparge pipe.

It is preferred that the duct assembly 9, which is included in the sparge pipes, be formed as a part of the water circulation system of a bubbling fluidized bed boiler whereby, as shown especially in FIG. 2, the first end of sparge pipes 1 is provided with a distribution header 11 connected to the duct assembly 9 of a sparge pipe or the like and included in the water circulation system of a fluidized bed boiler. At the second end of sparge pipes or the like on the wall opposite to the distributioin header, the duct assembly 9 joins a piping assembly providing the wall for the combustion chamber of a fluidized bed boiler. The sparge pipes can also be connected alternately to two distribution headers included in the opposite edges of a grate assembly, whereby both opposite walls of the combustion chamber are respectively connected to the water circulation cooling the grate assembly.

FIGS. 3–6 illustrate a few possible cross-sectional shapes for the sparge pipe in addition to the alternative shown in FIGS. 1 and 2. Especially FIG. 3 shows an alternative sparge pipe, wherein the sparge pipe has a cross-sectional shape which is a rectangle, the ducts 9*a* included in duct assembly 9 being mounted on the corners of the cross-sectional shape. The side walls 1*c* are longer than the top and bottom surface (the top and bottom horizontal wall) 1*a*, 1*b*. The elements for supplying fluidizing air comprise fluidizing nozzles as shown in FIGS. 1 and 2 as well as in FIG. 4. In FIG. 4, the ducts included in duct assembly 9 are located preferably centrally within the area of side walls 1*c* as well as top and bottom surface 1*a*, 1*b*. The walls 1*a*–1*c* of sparge pipe 1 may include one or a plurality of flat sheet elements 10 especially in accordance with the disposition of the ducts 9*a* of the duct assembly 9.

In particular FIGS. 5 and 6 illustrate alternative sparge pipe structures which otherwise correspond essentially to those shown in the preceding Figures except that the supply of fluidizing air from within the sparge pipe 1 is now adapted to occur through an aperture system 15 or the like included in the side walls 1*c* of sparge pipe 1 in essence immediately below the top surface 1*a*. The aperture system 15 is arranged longitudinally of the sparge pipe at certain distances. Thus, the sparge pipe top surface 1*a* (the horizontal top wall) directly and/or a sheet element included in the top surface is adapted to extend in the lateral direction of sparge pipe 1 or the like beyond the sparge pipe side walls 1*c* as a flange-like member as shown in FIG. 6. Alternatively or in addition to the solution just described, at least one, most preferably both side walls 1*c* are adapted to extend from the top surface 1*a* obliquely downward (see also the sparge pipe embodiment of FIG. 1) toward the bottom surface 1*b* (the horizontal bottom wall) of sparge pipe 1 or the like. The bottom surface being narrower than the top surface 1*a* as viewed in the cross-section perpendicular to the longitudinal direction of the sparge pipe 1.

A grate assembly of the invention is particularly but not exclusively suitable for bubbling fluidized bed boilers. In a bubbling fluidized bed boiler, the fluidizing air has such a fluidizing rate that heavy particles fall more or less vertically down. A grate assembly of the invention makes it possible that the aperture system is evenly distributed over the surface area of an entire grate assembly and has a sufficient surface area resulting in a high probability for the coarse particles to end up in the aperture system.

The invention can also be advantageously applied in a circulating fluidized bed boiler, wherein the fluidizing air uses a fluidizing rate that produces also lateral motion for the coarse particles. Even in this case, a grate assembly of the invention provides a high probability for the coarse particles to end up in the aperture system.

We claim:

1. A grate assembly for a fluidized bed boiler which includes a combustion chamber located above said grate assembly for effecting a combustion process and receiving means, located below said grate assembly, for receiving at least some fluidized bed material, said grate assembly comprising:

a plurality of parallel sparge pipes positioned in a substantially horizontal plane and including fluidizing air means extending towards said combustion chamber for supplying fluidizing air from said sparge pipes into said combustion chamber; and aperture means, formed between adjacent sparge pipes, for discharging said at least some fluidized bed material into said receiving means, wherein at least some of said sparge pipes include therein cooling means for circulating a cooling medium through said fluidized bed boiler.

2. The device according to claim 1, wherein said at least some of said sparge pipes comprise a wall structure which includes said cooling means.

3. The device according to claim 1, wherein said cooling means form a duct assembly which extends in a substantially longitudinal direction of said sparge pipes, and wherein said duct assembly forms a partial peripheral area in said at least some of said sparge pipes.

4. The device according to claim 1, wherein said duct assembly comprises a plurality of ducts which form a partial outer surface and a partial inner surface in said at least some of said sparge pipes.

5. The device according to claim 3, wherein said cooling medium is water, and wherein one end of said at least some of said sparge pipes includes a distribution header connected to said duct assembly which at the other end of said at least some of said sparge pipes forms a wall for said combustion chamber.

6. The device according to claim 3, wherein said duct assembly comprises at least four ducts which are peripherally disposed on said sparge pipes and spaced apart from each other, and wherein said duct assembly further comprises spacer means, located between adjacent ducts, which include sheet elements.

7. The device according to claim 1, wherein said sparge pipes have a polygonal shape and include a top surface which forms a top surface for said grate and duct assembly.

8. The device according to claim 1, wherein a top surface in said sparge pipes extends laterally beyond a side wall of said sparge pipes, said side wall including at least one aperture for supplying said fluidizing air.

9. The device according to claim 8, wherein said top surface comprises a flange.

10. The device according to claim 8, wherein said side wall extends obliquely toward a bottom surface of said sparge pipes, said bottom surface being narrower than said top surface.

11. The device according to claim 1, wherein said fluidized bed boiler comprises a bubbling fluidized bed boiler.

12. The device according to claim 1, wherein said fluidized bed boiler comprises a circulating fluidized bed boiler.

* * * * *